US009903181B2

(12) United States Patent
Myerley et al.

(10) Patent No.: US 9,903,181 B2
(45) Date of Patent: Feb. 27, 2018

(54) COMMUNICATION AND LOCK OPEN SAFETY VALVE SYSTEM AND METHOD

(71) Applicants: Thomas S. Myerley, Broken Arrow, OK (US); Doug A. Lowry, Broken Arrow, OK (US)

(72) Inventors: Thomas S. Myerley, Broken Arrow, OK (US); Doug A. Lowry, Broken Arrow, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 611 days.

(21) Appl. No.: 14/328,013

(22) Filed: Jul. 10, 2014

(65) Prior Publication Data

US 2016/0010430 A1 Jan. 14, 2016

(51) Int. Cl.

| | |
|---|---|
| ***E21B 34/14*** | (2006.01) |
| ***E21B 34/10*** | (2006.01) |
| ***E21B 34/00*** | (2006.01) |

(52) U.S. Cl.

CPC ..... *E21B 34/14* (2013.01); *E21B 34/102* (2013.01); *E21B 2034/005* (2013.01)

(58) Field of Classification Search

CPC ..... E21B 34/08; E21B 34/14; E21B 34/10; E21B 34/12

See application file for complete search history.

(56) References Cited

U.S. PATENT DOCUMENTS

| | | | | |
|---|---|---|---|---|
| 1,354,582 | A * | 10/1920 | Shimp | F16K 27/0263 122/DIG. 15 |
| 4,248,308 | A * | 2/1981 | Pringle | E21B 34/105 166/322 |
| 6,030,004 | A | 2/2000 | Schock et al. | |
| 6,260,850 | B1 | 7/2001 | Beall et al. | |
| 7,137,452 | B2 | 11/2006 | McVicker | |
| 7,409,996 | B2 | 8/2008 | Myerley et al. | |
| 8,118,093 | B2 | 2/2012 | Hassell et al. | |
| 8,191,634 | B2 | 6/2012 | Xu | |
| 9,290,998 | B2 * | 3/2016 | Radford | E21B 41/00 |
| 2004/0065442 | A1 * | 4/2004 | Myerley | E21B 29/08 166/373 |

OTHER PUBLICATIONS

Bolding, et al.; "Damaged Control Line Replacement Safety Valve System: Thru-Tubing"; SPE 121407; (2009); 12 pages.

Geyelin, J.L.; "Down Hole Safety Valve for Concentric Completion";(1987); SPE; 7 pages.

* cited by examiner

*Primary Examiner* — David J Bagnell
*Assistant Examiner* — Manuel C Portocarrero
(74) *Attorney, Agent, or Firm* — Cantor Colburn LLP

(57) ABSTRACT

A downhole system includes a safety valve system. The safety valve system includes a tubular housing having a hydraulic control chamber, and a lock-open communication sleeve within the tubular housing. The sleeve is longitudinally movable with respect to the tubular housing. The sleeve has a downhole end portion configured to abut and enact downhole movement of a flow tube. The sleeve further has a radial communication sort alignable with the hydraulic control chamber. A method of communicating and locking open the safety valve includes using the sleeve.

18 Claims, 4 Drawing Sheets

COMMUNICATION AND LOCK OPEN SAFETY VALVE SYSTEM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A production tubing string is typically run thousands of feet into a well bore. Generally, when running a tubing string downhole, it is desirable, and in some cases required, to include a safety valve on the tubing string. The safety valve typically has a fail safe design whereby the valve will automatically close to prevent production fluid from flowing through the tubing, should, for example, the surface production equipment be damaged or malfunction.

Should the safety valve become inoperable, the safety valve may be retrieved to surface. The tubing retrievable surface controlled subsurface safety valve ("TRSV") is attachable to production tubing string and includes a flapper pivotally mountable on the lower end of the safety valve assembly by a flapper pin. A torsion spring is provided to bias the flapper in the closed position to prevent fluid flow through the tubing string. When fully closed the flapper seals off the inner diameter of the safety valve assembly preventing fluid flow therethrough. A flow tube is provided above the flapper to open and close the flapper. The flow tube is adapted to be movable axially within the safety valve assembly. When the flapper is closed, the flow tube is in its uppermost position; when the flow tube is in its lowermost position, the lower end of the flow tube operates to extend through and pivotally open the flapper. When the flow tube is in its lowermost position and the flapper is open, fluid communication through the safety valve assembly is allowed. A rod piston contacts the flow tube to move the flow tube. The rod piston is located in a hydraulic piston chamber within the TRSV. The upper end of the chamber is in fluid communication, via a control line, with a hydraulic fluid source and pump at the surface. Seals are provided such that when sufficient control fluid (e.g. hydraulic fluid) pressure is supplied from surface, the rod piston moves downwardly in the chamber, thus forcing the flow tube downwardly towards the flapper to open the valve. When the control fluid pressure is removed, the rod piston and flow tube move upwardly allowing the biasing spring to move the flapper and thus the valve, to the closed position.

If the TRSV becomes inoperable or malfunctions due to the buildup of materials such as paraffin, fines, and the like on the components downhole, e.g., such that the flapper does not fully close or does not fully open, it is known to replace the TRSV by retrieving the safety valve assembly to surface by pulling the entire tubing string from the well and replacing the safety valve assembly with a new assembly, and then rerunning the safety valve and the tubing string back into the well. Because of the length of time and expense required for such a procedure, it is known to run a replacement safety valve downhole within the TRSV. These replacement safety valves are run downhole via a wireline, and thus often referred to as wireline insertable safety valves ("WISV"). Before inserting the WISV into the TRSV assembly, however, two operations are performed. First, the TRSV is locked in its open position (i.e., the flapper must be maintained in the open position); and second, fluid communication is established from the existing control fluid line to the interior of the TRSV, thus providing control fluid (e.g. hydraulic fluid) to the WISV. Lockout tools perform the former function; communication tools perform the latter. When it is desired to lock the safety valve assembly in its open position, the lockout tool is lowered through the tubing string and into the TRSV. The lockout tool is then actuated to lock the valve mechanism (e.g. the flapper) of the TRSV in the open position.

Before inserting the WISV, communication is established between the hydraulic chamber of the TRSV and the internal diameter of the TRSV. A cutter of the communication tool is utilized to provide fluid communication between the inner diameter of the TRSV and the hydraulic chamber, so that the hydraulic control line from surface can be utilized to operate the WISV. Once communication has been established with the hydraulic chamber, the WISV is subsequently run downhole. The WISV may resemble a miniature version of the TRSV assembly. The WISV is placed within the inner diameter of the TRSV assembly. The WISV includes an upper seal above the communication flow passageway and a lower seal below the flapper and at a bottom sub, and the control line to the TRSV is used to actuate the valve mechanism of the WISV. More specifically, the upper and lower seals allow control fluid from the control line to communicate with the hydraulic chamber and piston of the WISV in order to actuate the valve of the WISV between the open and closed positions. Once the WISV is in place, the wireline is removed and the tubing string placed on production.

The art would be receptive to alternative devices and for downhole systems incorporating TRSV and WISV, and improved methods for operating such systems.

BRIEF DESCRIPTION

A downhole system includes a safety valve system. The safety valve system includes a tubular housing having a hydraulic control chamber, and a lock-open communication sleeve within the tubular housing. The sleeve is longitudinally movable with respect to the tubular housing. The sleeve has a downhole end portion configured to abut and enact downhole movement of a flow tube. The sleeve further has a radial communication port alignable with the hydraulic control chamber.

A method of communicating and locking open a tubing retrievable safety valve ("TRSV") includes engaging a lock-open communication sleeve within a tubular housing, the sleeve having a radial communication port, longitudinally moving the sleeve within the housing to align the radial communication port with a hydraulic control chamber in the housing, and abutting a flow tube with a downhole end portion of the sleeve and longitudinally moving the flow tube to open the valve.

A downhole system includes a safety valve system. The safety valve system includes a tubular housing having a hydraulic control chamber and a rotatable sleeve within the tubular housing. The sleeve is longitudinally movable with respect to the tubular housing when rotated. The sleeve includes at least one of a downhole end portion, configured to abut and enact downhole movement of a flow tube to lock open a flapper valve, and a radial communication port, alignable with the hydraulic control chamber upon rotation of the sleeve, the radial communication port configured to communicate an interior of the tubular housing and sleeve with the hydraulic control chamber.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
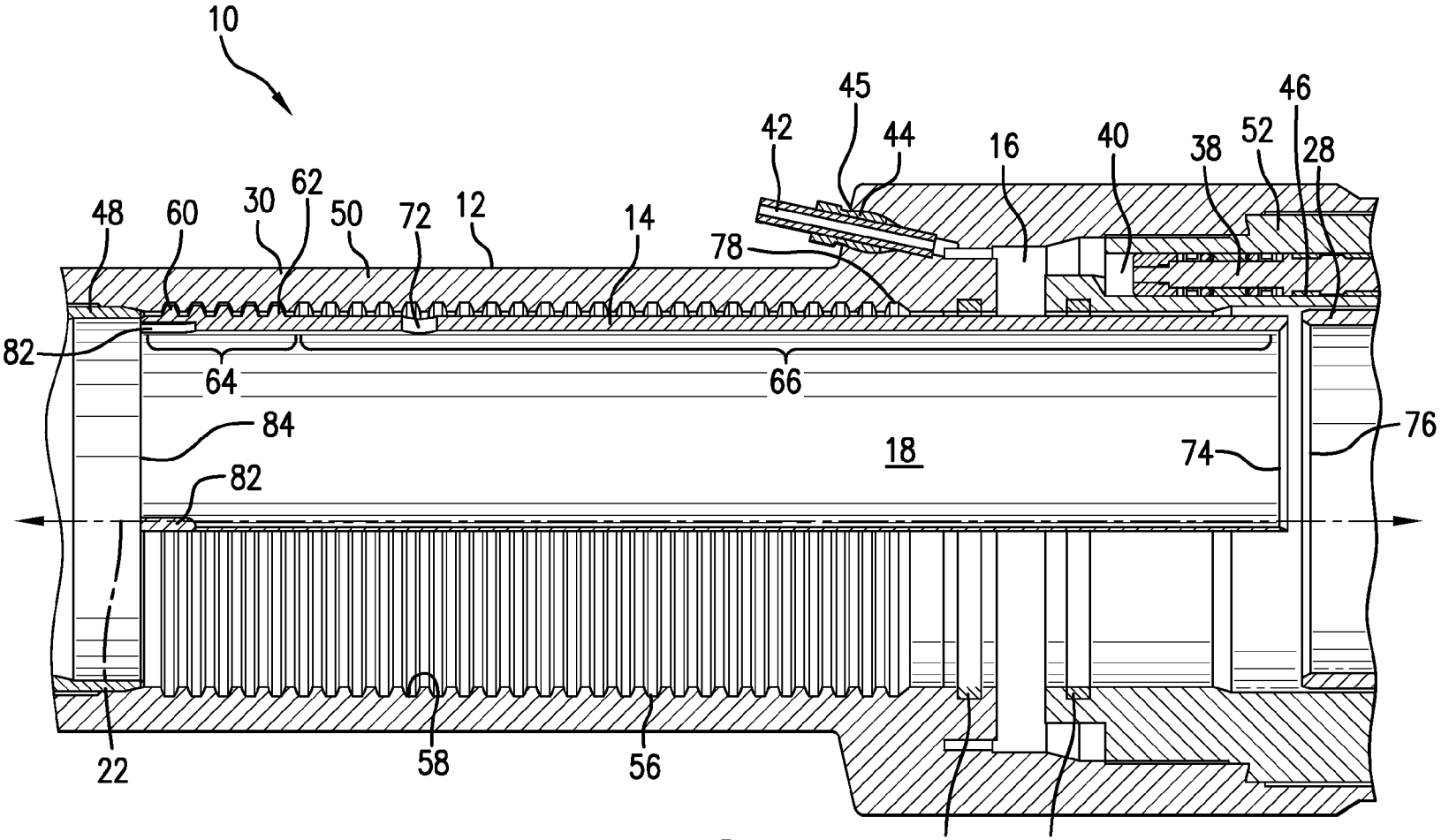
FIG. 1 depicts a partial side cross-sectional view of an exemplary embodiment of a tubing retrievable safety valve ("TRSV") and a partial side cross-sectional view of an exemplary embodiment of a lock-open/communication ("LOC") sleeve in an uphole position.
Figure 2:
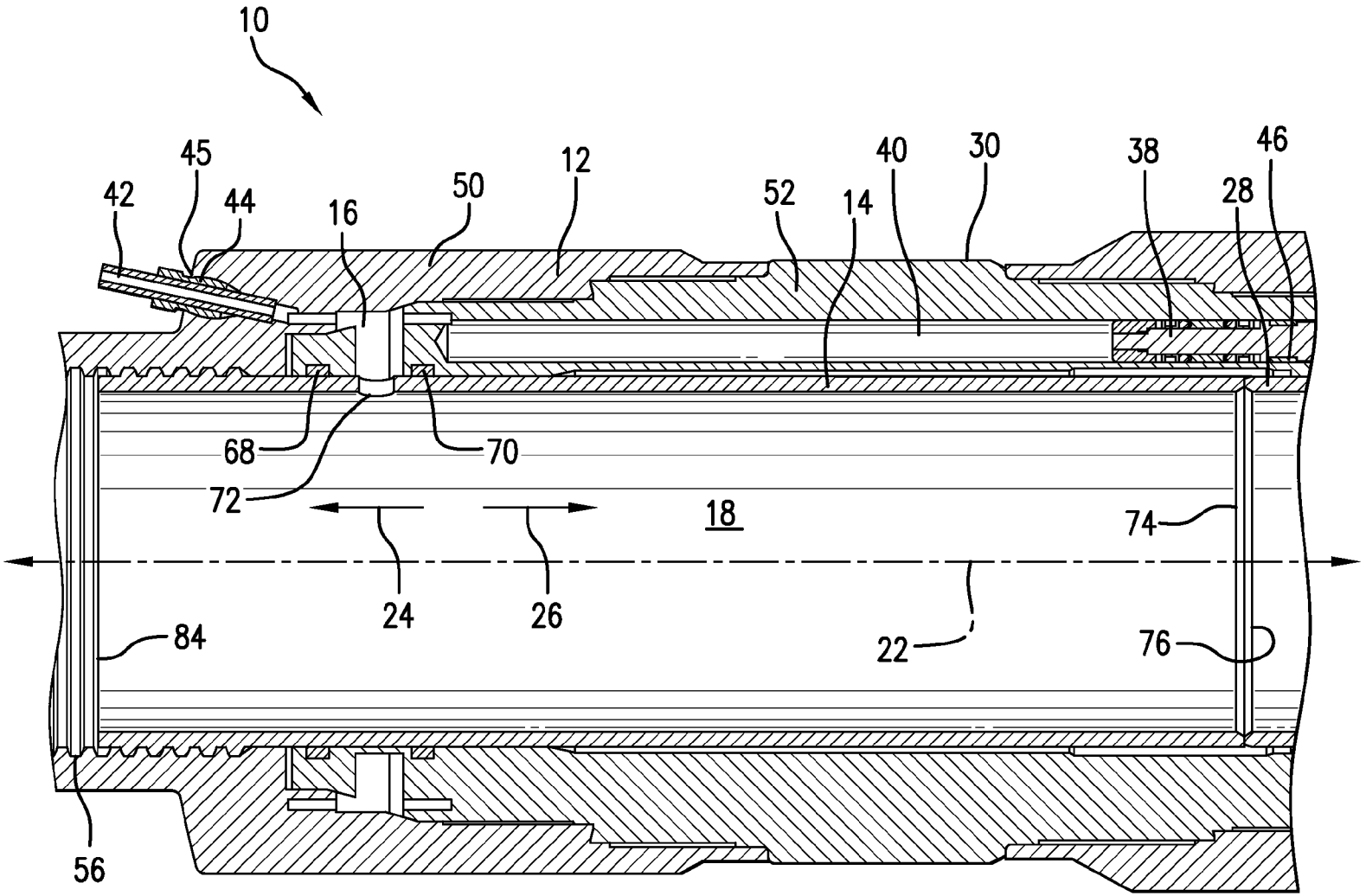
FIG. 2 depicts a partial cross-sectional view of an exemplary embodiment of a TRSV with the LOC sleeve of FIG. 1 moved to a downhole position.
Figure 3:
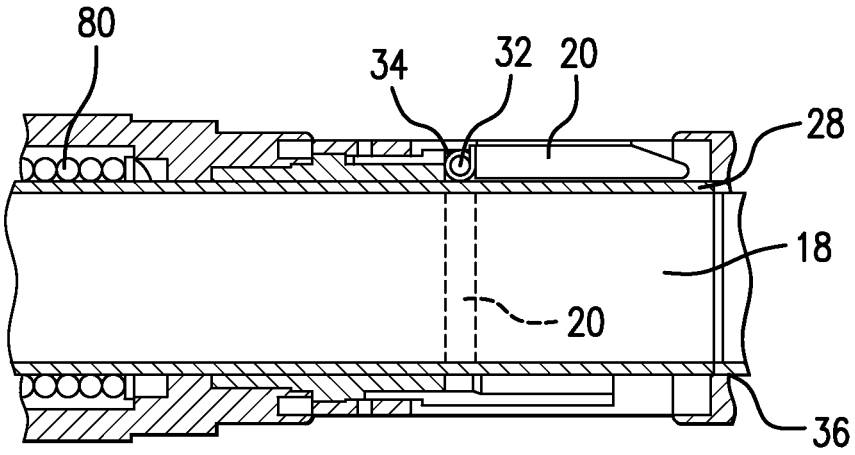
FIG. 3 depicts a cross-sectional view of a downhole portion of the exemplary TRSV of FIGS. 1 and 2.
Figure 4:
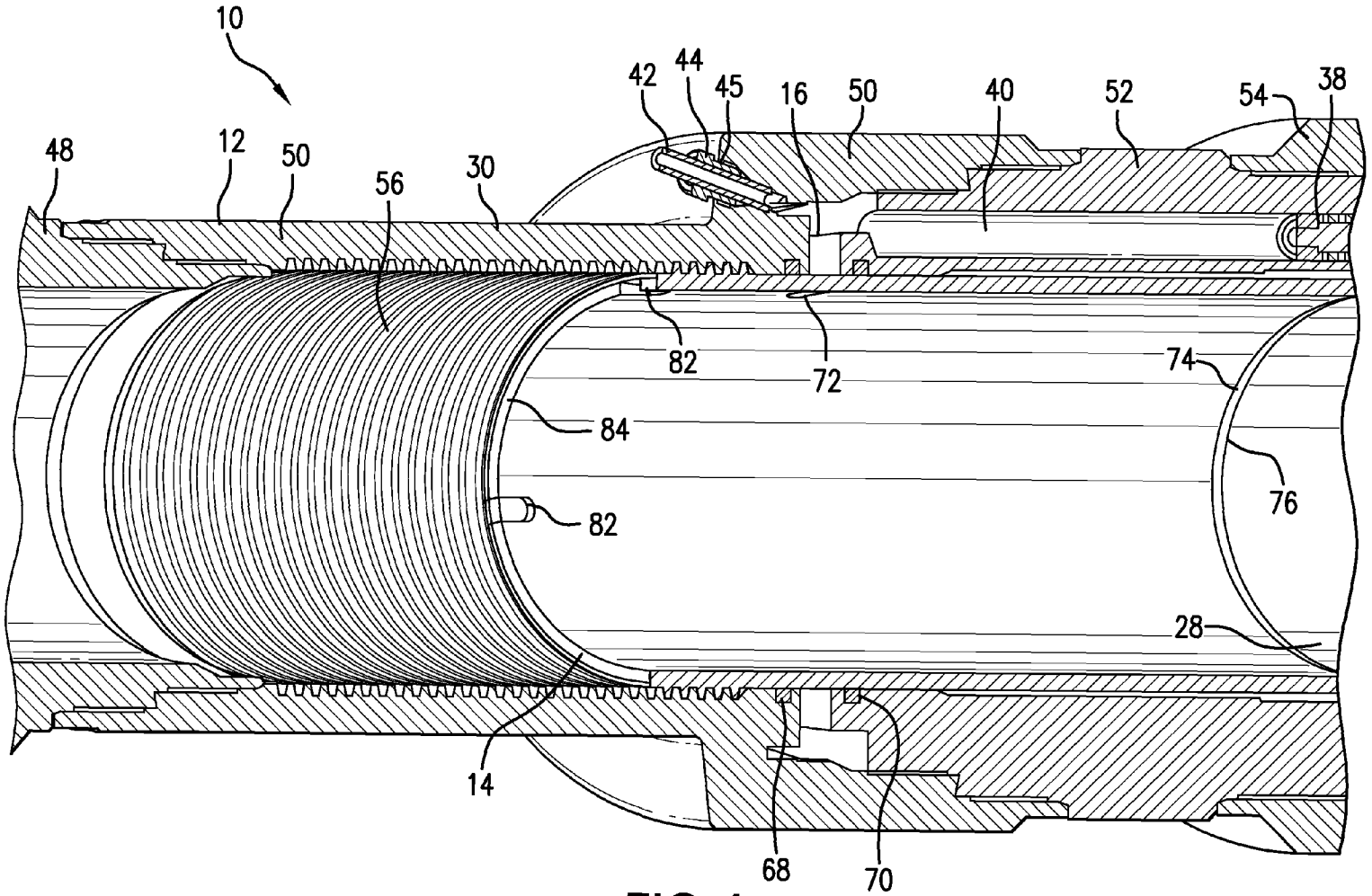
FIG. 4 depicts a perspective and partial cross-sectional view of the TRSV and LOC sleeve of FIG. 1; and, FIG. 5 depicts a partial side view of an exemplary embodiment of an actuating tool for rotating the LOC sleeve.

An exemplary embodiment of a downhole system 10 having a tubing retrievable safety valve ("TRSV") 12 including a lock/open communication ("LOC") sleeve 14 is shown in FIGS. 1, 2 and 4 with a downhole portion of the TRSV 12 shown in FIG. 3. The TRSV 12 may be just one part of the downhole system 10, which may further include, but not limited to, many sections of tubing, joints, and other downhole tools. As will be further described below, the LOC sleeve 14 is configured to establish communication between the hydraulic control chamber 16 of the TRSV 12 and the interior/flowpath 18 of the TRSV 12 when needed for a wireline insertable safety valve ("WISV") (not shown). The LOC sleeve 14 is additionally configured to lock the flapper 20 of the TRSV 12 (FIG. 3) into the open position at substantially the same time that the communication is established. An exemplary embodiment of a WISV is shown in U.S. Pat. No. 6,260,850, herein incorporated by reference in its entirety, however it should be understood that various embodiments of a WISV may be utilized once the TRSV 12 is communicated and locked open.

The illustrated TRSV 12 is a tubular device having a longitudinal axis 22. For illustrative purposes, a cutaway view of LOC sleeve 14 is shown in FIG. 1. The interior 18 of the TRSV 12 provides a flow path for passing production fluids in an uphole direction 24 or injection fluids in a downhole direction 26. With reference to FIG. 3, when the flapper 20 of the TRSV 12 is in an open position, the flapper 20 is secured between flow tube 28 and housing 30 of the TRSV 12. The flapper 20 is pivotally mountable on the downhole portion of the TRSV 12, such as by a flapper pin 32. A biasing member 34, such as a torsion spring, is provided to bias the flapper 20 in the closed position (shown by dotted lines) to prevent and block, or at least substantially prevent and block, flow through the flow path of the interior 18 of the TRSV 12 and downhole system 10. The flow tube 28 is provided uphole of the flapper 20 to open and close the flapper 20. The flow tube 28 is positioned radially inward of the housing 30 of the TRSV 12 and is adapted to be movable longitudinally within the TRSV 12. The flow tube 28 is positioned downhole of the LOC sleeve 14. When the flapper 20 is in the closed position blocking the flow through the flow path of the interior 18 as shown by the dashed lines in FIG. 3, the flow tube 28 is in its uphole position allowing the biasing member 34 to bias the flapper 20 to the closed position. When the flow tube 28 is in its downhole position, the downhole end portion 36 of the flow tube 28 operates to extend downhole through the interior 18 and pivotally open the flapper 20. When the flow tube 28 is in its downhole position and the flapper 20 is open, fluid communication through the flowpath 18 of the TRSV 12 is allowed.

A piston 38, such as a rod piston, is operatively connected to the flow tube 28 to move the flow tube 28. The piston 38 may be rod shaped, and the piston chamber 40 may be sized to accommodate any exterior shape of the piston 38. Movement of the piston 38 translates to movement of the flow tube 28, and likewise movement of the flow tube 28 translates to movement of the piston 38. The piston 38 is located in the piston chamber 40 within the housing 30 of the TRSV 12. The piston chamber 40 is in fluid communication with the hydraulic chamber 16. A portion, such as an uphole portion, of the hydraulic chamber 16 is in fluid communication, via a control line 42 (a partial portion of which is illustrated), with a hydraulic fluid source and pump at the surface (not shown). The control line 42 may be secured to the housing 30 via a hydraulic fitting 44 at a hydraulic port 45 of the housing 30, the hydraulic port 45 in communication with the hydraulic control chamber 16. Seals 46 may be provided about the piston 38 such that when sufficient control fluid (e.g. hydraulic fluid) pressure is supplied from surface, the piston 38 moves in downhole direction 26 in the piston chamber 40, compressing a power spring 80 (FIG. 3) at a downhole end of the piston 38, and forcing the flow tube 28 towards the flapper 20 to move the flapper 20 to the open position, opening the TRSV 12. When the control fluid pressure is removed, the piston 38 and flow tube 28 move back in uphole direction 24 allowing the biasing member 34 to move the flapper 20 and thus the TRSV 12, to the closed position.

The housing 30 of the TRSV 12 may include a nipple adapter 48 attached to a top sub 50, the top sub 50 connected to a cylinder sub 52, and the cylinder sub 52 connected to a bottom sub 54. Together, the nipple adapter 48, top sub 50, cylinder sub 52, and bottom sub 54 are referred to as the housing 30 of the TRSV 12, however the housing 30 may take on various shapes and differing subs as needed. The housing 30, or in particular the top sub 50, includes a helical groove or female/internal thread 56 on an interior surface 58 of the housing 30 configured to receive a helical or male/external thread 60 on a threaded portion 62 of an exterior surface 64 of the LOC sleeve 14. The hydraulic control chamber 16 may be formed in the top sub 50 between the top sub 50 and the cylinder sub 52 as shown in FIGS. 1 and 4, although in alternate embodiments the hydraulic control chamber 16 may be formed in the cylinder sub 52, such as shown in FIG. 2. The hydraulic control chamber 16 is thus formed in the housing 30. The hydraulic control chamber 16 may either be annular or simply a section of the top sub 50/cylinder sub 52/housing 30. That is, an annular hydraulic chamber 16 may be replaced by a non-annular hydraulic chamber as long as the geometry of the piston chamber 40 is appropriately modified to allow communication with the non-annular hydraulic chamber.

Without the LOC sleeve 14 in place, the hydraulic control chamber 16 would be open to the interior 18 of the TRSV 12. However, in normal operation of the TRSV 12 (prior to necessitating the need for communicating the hydraulic chamber 16 to operate a WISV), the hydraulic control chamber 16 is covered by the LOC sleeve 14, such as by a non-threaded portion 66 of the LOC sleeve 14, and sealed from the interior 18 of the TRSV 12 by a first (uphole) seal 68 and a second (downhole) seal 70 between the LOC sleeve 14 and the housing 30. The LOC Sleeve 14 creates an inner surface of the hydraulic chamber 16 by radially interiorly covering the two seals 68, 70 in the top sub 50 and the cylinder sub 52, and spanning the inner exposed surface area of the hydraulic control chamber 16. Under normal operation of the TRSV 12, the LOC sleeve 14 forms a surface of the hydraulic control chamber 16. The first and second seals 68, 70 may be cylindrical type seals, and although only two seals 68, 70 are shown in particular locations it should be understood that a variety of seal types may be used to create the seal between the LOC Sleeve 14 and the hydraulic chamber 16. The LOC sleeve 14 is positioned within the housing 30 to cover and seal a radially interior portion of the hydraulic control chamber 16 from the interior 18 of the TRSV 12 in normal operation of the TRSV 12. Normal operation of the TRSV 12 involves utilizing the hydraulic control line 42 to pressurize the hydraulic chamber 16 to move the piston 38 in the downhole direction 26 and open the flapper 20 by moving the flow tube 28 with the piston 38 to push the flapper 20 to the open condition. Also, when the flapper 20 needs to close, or when the flapper 20 is closed due to a fail-safe condition, the hydraulic pressure in the chamber 16 will be reduced such that the piston 38 and flow tube 28 move back towards an uphole position in the uphole direction 24, allowing the flapper 20 to move to its biased closed position.

When the TRSV 12 is operable, the flow tube 28 is movable in both uphole and downhole directions 24, 26 while the LOC sleeve 14 remains in the position shown in FIG. 1, covering the hydraulic control chamber 16. However, if the TRSV 12 becomes inoperable, and a WISV is to be run downhole as a replacement, the LOC sleeve 14 can be longitudinally moved from the position shown in FIG. 1 in the downhole direction 26 to the position shown in FIG. 2, such as by rotation of the LOC sleeve 14 within the housing 30. The LOC sleeve 14 includes at least one radial communication port 72 or slot in the non-threaded portion 66, such that moving the LOC sleeve 14 downhole aligns the radial port 72 or slot with the hydraulic control chamber 16 between the first and second seals 68, 70 to provide a path for control fluid from the port 45 to reach the interior 18 of the TRSV 12 for the purpose of operating the WISV in the event that the TRSV 12 becomes inoperable. Further, movement of the LOC sleeve 14 in the downhole direction 26 moves the flow tube 28 of the TRSV 12 in the downhole direction 26, locking the flapper 20 into the open position shown in FIG. 3. To move the flow tube 28 in the downhole direction 26, the downhole end 74 of the LOC sleeve 14 abuts with an uphole end 76 of the flow tube 28. The downhole movement of the LOC sleeve 14 may be stopped by a shoulder 78, or final interior thread, on the interior surface 58 of the housing 30. That is, when the downhole-most portion of the threaded portion 62 engages with the shoulder 78 as shown in FIGS. 1 and 4, further downhole movement of the LOC sleeve 14 will be prevented. This stop also coincides with alignment of the communication port 72 with the hydraulic chamber 16, and with an open (trapped/locked) position of the flapper 20.

The downhole movement of the LOC sleeve 14 thus establishes both hydraulic communication between the interior 18 and the hydraulic chamber 16 and lock-open of the flapper 20. One tool (the LOC sleeve 14) and one downhole trip is required to perform both the communication or communication and lock-open operations. Flow through is then allowed through the flowpath 18 because of the locked-open flapper 20, and a WISV may be subsequently inserted in the TRSV 12. Also, the LOC sleeve 14 enables the ability to return the flow tube 28 and compressed power spring 80 back to the normal operation position for redress, eliminating at least some of the safety risks of working with a compressed power spring 80.

Figure 5:
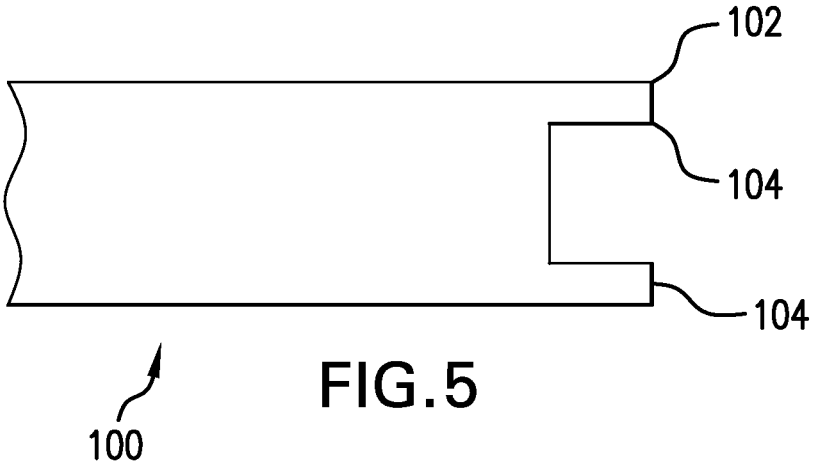

As described above, the exterior surface 64 of the LOC Sleeve has a threaded portion 62 having external thread 60 that produces movement in the downhole direction when the LOC sleeve 14 is rotated, via rotary to linear motion. In one exemplary embodiment, the direction of the threads 56, 60 would be for downhole movement during left-hand rotation (counter-clockwise rotation) to prevent movement of the sleeve 14 during operations using the more common right-hand rotation. The housing 30 includes matching threads or groove/pin for rotation purposes. In the event of failure of the TRSV 12 or planned use of a WISV, an actuation tool 100 (FIG. 5) could be deployed to rotate the LOC sleeve 14. In an exemplary embodiment, the LOC sleeve 14 may have slots 82 in an uphole end 84 or portion of the LOC sleeve 14 to accept a latching feature 102 of the actuation tool 100. The latching feature 102 may include fingers 104 sized for receipt within the slots 82. This allows rotation to be applied to the LOC sleeve 14. Rotation of the actuation tool 100 could be created by using downhole jarring and a J-slot mechanism (not shown) or by rotating the tool 100 itself using coiled tubing.

Rotation of the LOC sleeve 14 moves the port 72 located in the sleeve 14 from a position uphole of the first seal 68 and longitudinally distanced from the hydraulic control chamber 16, to a position downhole of the first seal 68 (but still uphole of the second seal 70), establishing hydraulic control fluid communication between the hydraulic control chamber 16 with the interior 18 of the TRSV 12 as described above. Furthermore, the rotation of the LOC sleeve 14 also pushes the flow tube 28 in the downhole direction 26, compressing the power spring 80 and opening the flapper 20. This will leave the flapper 20 locked in the open position where, unlike some other systems, it cannot be closed by flow or wireline operations. Advantageously, this method provides the ability to return the power spring 80 to the pre-compressed position, eliminating or at least potentially substantially reducing safety risks involved with disassembling a fully compressed power spring 80. While the ability to perform both communication and lock open operations provides the system 10 and TRSV 12 with significant advantages, the ability to either lock open the flapper 20 by rotating the sleeve 14 or communicate the hydraulic chamber 16 by rotating the sleeve 14 would also provide advantages to a system 10, if both actions are not required.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc.

are used to distinguish one element from another. Furthermore, the use of the terms a, an, etc. do not denote a limitation of quantity, but rather denote the presence of at least one of the referenced item.

What is claimed is:

1. A downhole system including a safety valve system, the safety valve system comprising:

a tubular housing having a hydraulic control chamber;

a flow tube longitudinally movable within the housing;

a flapper movable from a closed position, at least substantially blocking a longitudinal flow path through the tubular housing, to an open position, the flapper moved to the open position by downhole movement of the flow tube; and, a lock-open communication sleeve within the tubular housing, the sleeve longitudinally movable with respect to the tubular housing, the sleeve having a downhole end portion configured to abut and enact downhole movement of the flow tube, the sleeve further having a radial communication port alignable with the hydraulic control chamber;

wherein, in a first condition, the flow tube is movable utilizing pressure in the hydraulic control chamber and the radial communication port is not aligned with the hydraulic control chamber, and, in a second condition, the flow tube is longitudinally moved downhole by the sleeve to restrain the flapper in the open position and the radial communication port is aligned with the hydraulic control chamber.

2. The downhole system of claim 1, wherein the sleeve is rotatable within the tubular housing.

3. The downhole system of claim 2, wherein the sleeve includes an external thread, and the tubular housing includes an internal thread corresponding with the external thread of the sleeve.

4. The downhole system of claim 3, wherein the external thread is a left-hand thread.

5. The downhole system of claim 1, wherein rotation of the sleeve within the tubular housing converts to the downhole movement of the sleeve.

6. The downhole system of claim 1, further comprising a piston connected to and movable with the flow tube, a piston chamber housing the piston in communication with the hydraulic control chamber.

7. The downhole system of claim 1, wherein an uphole end portion of the sleeve includes an actuation tool engagement area.

8. The downhole system of claim 7, wherein the actuation tool engagement area is a slot in the sleeve, the slot configured to receive an actuation tool.

9. The downhole system of claim 1 wherein the sleeve includes a threaded portion and a non-threaded portion, the radial communication port disposed in the non-threaded portion.

10. The downhole system of claim 1, further comprising a pair of seals flanking the hydraulic control chamber, wherein the radial communication port is sealed from the hydraulic control chamber until it is aligned with the hydraulic control chamber.

11. The downhole system of claim 1, wherein a wall of the hydraulic control chamber is formed by the sleeve until the radial communication port is aligned with the hydraulic control chamber.

12. A method of communicating and locking open a tubing retrievable safety valve, the method comprising:

engaging a lock-open communication sleeve within a tubular housing, the sleeve having a radial communication port;

longitudinally moving the sleeve within the housing to align the radial communication port with a hydraulic control chamber in the housing; and, abutting a flow tube with a downhole end portion of the sleeve and longitudinally moving the flow tube to open the valve.

13. The method of claim 12, wherein the radial communication port is aligned with the hydraulic communication chamber when the valve is opened due to longitudinal movement of the flow tube.

14. The method of claim 12, wherein longitudinally moving the sleeve within the housing includes rotating the sleeve via cooperating threads in the housing and sleeve.

15. The method of claim 14, wherein rotating the sleeve includes rotating the sleeve in a first direction and longitudinally moving the flow tube compresses a power spring in the safety valve, and further comprising rotating the sleeve in an opposite direction to decompress the power spring.

16. The method of claim 12, wherein engaging the lock-open communication sleeve includes engaging an actuating tool with a slot in an uphole end portion of the sleeve, the actuating tool run within the tubular housing.

17. The method of claim 12, further comprising moving a flapper from a closed position at least substantially blocking a longitudinal flow path through the tubular housing, and an open position, wherein moving the flapper occurs via longitudinal movement of the flow tube by abutting the flow tube with the downhole end portion of the sleeve.

18. A downhole system including a safety valve system, the safety valve system comprising:

a tubular housing having a hydraulic control chamber;

a flow tube longitudinally movable within the housing;

a flapper movable from a closed position, at least substantially blocking a longitudinal flow path through the tubular housing, to an open position, the flapper moved to the open position by downhole movement of the flow tube; and, a rotatable sleeve within the tubular housing, the sleeve longitudinally movable with respect to the tubular housing when rotated, the sleeve including downhole end portion, configured to abut and enact downhole movement of the flow tube to lock open the flapper valve, and a radial communication port, alignable with the hydraulic control chamber upon rotation of the sleeve, the radial communication port configured to communicate an interior of the tubular housing and sleeve with the hydraulic control chamber.

* * * * *